US007535373B2

(12) United States Patent
Dalzell

(10) Patent No.: US 7,535,373 B2
(45) Date of Patent: May 19, 2009

(54) SECURITY TECHNIQUES FOR ELECTRONIC DEVICES

(75) Inventor: William J. Dalzell, Parrish, FL (US)

(73) Assignee: Honeywell International, Inc., Morristown, NJ (US)

( * ) Notice: Subject to any disclaimer, the term of this patent is extended or adjusted under 35 U.S.C. 154(b) by 154 days.

(21) Appl. No.: 11/295,837

(22) Filed: Dec. 6, 2005

(65) Prior Publication Data

US 2007/0013538 A1 Jan. 18, 2007

Related U.S. Application Data

(60) Provisional application No. 60/699,688, filed on Jul. 15, 2005.

(51) Int. Cl.
*G08B 13/18* (2006.01)

(52) U.S. Cl. ..... 340/652; 340/657; 340/635; 340/541; 713/194

(58) Field of Classification Search ..... 340/5.65, 340/652, 657, 635, 590, 545.5; 235/492; 701/71; 385/115, 120; 713/194
See application file for complete search history.

(56) References Cited

U.S. PATENT DOCUMENTS 4,811,288 A * 3/1989 Kleijne et al. ..... 365/52
5,376,857 A * 12/1994 Takeuchi et al. ..... 310/328
5,619,025 A * 4/1997 Hickman et al. ..... 235/454
6,339,380 B1 * 1/2002 Wilson ..... 340/663
6,584,660 B1 * 7/2003 Shimogawa et al. ..... 29/25.35
6,982,642 B1 * 1/2006 Cesana et al. ..... 340/550
7,015,823 B1 * 3/2006 Gillen et al. ..... 340/652
7,054,162 B2 * 5/2006 Benson et al. ..... 361/760
7,065,656 B2 * 6/2006 Schwenck et al. ..... 713/194
7,126,261 B2 * 10/2006 Shibata et al. ..... 310/366
2003/0009684 A1 * 1/2003 Schwenck et al. ..... 713/194
2004/0113792 A1 * 6/2004 Ireland et al. ..... 340/572.8
2004/0195001 A1 * 10/2004 Farquhar et al. ..... 174/261
2005/0179344 A1 * 8/2005 Shibata et al. ..... 310/328
2006/0087883 A1 * 4/2006 Ozguz et al. ..... 365/185.04
2006/0138243 A1 * 6/2006 Bi et al. ..... 235/487
2006/0195705 A1 * 8/2006 Ehrensvard et al. ..... 713/194
2006/0255953 A1 * 11/2006 Lyon et al. ..... 340/572.8

* cited by examiner

*Primary Examiner*—George A Bugg
*Assistant Examiner*—Hoi C Lau
(74) *Attorney, Agent, or Firm*—McDonnell Boehnen Hulbert & Berghoff LLP

(57) ABSTRACT

Systems and methods for protecting electronic and other sensitive devices in the event of security breaches such as physical intrusion or access, tampering, and attempts at reverse engineering. One aspect of the present invention provides security systems and methods that utilize an active security measure that can identify a security breach and respond with a protective action. Protective actions may include erasure or randomizing of data or software, activation of an alarm or signal (such as at a remote location), or destruction of any portion of a protected device or circuit or the like.

17 Claims, 1 Drawing Sheet

SECURITY TECHNIQUES FOR ELECTRONIC DEVICES

CROSS-REFERENCE TO RELATED APPLICATIONS

The present non-provisional Application claims the benefit of commonly owned provisional Application having Ser. No. 60/699,688, filed on Jul. 15, 2005, and entitled SECURITY TECHNIQUES FOR ELECTRONIC DEVICES, which Application is incorporated herein by reference in its entirety.

TECHNICAL FIELD

The present invention relates to security techniques for electronic devices, particularly microelectronic devices. More particularly, the present invention relates to methods and systems for protecting electronic and other sensitive devices from security breaches such as tampering and reverse engineering.

BACKGROUND

Electronic systems often incorporate valuable structures, software code, data, circuit components, intellectual property, and the like. These valuable items can be targets of espionage from competitors, foreign governments, and other adversaries. An unauthorized entity may attempt to gain possession of such systems and then use reverse engineering methodologies to harvest as much valuable technology, especially data and software, as it can. Consequently, protective technologies are incorporated into electronic systems in order to frustrate these kinds of prying activities.

Security protection can be passive or active. Passive protection generally imposes barriers of some sort that can delay, prevent, or otherwise confound reverse engineering. Active protection generally provides some response to the occurrence of one or more triggering events that indicate an unauthorized intrusion attempt is in progress. Because an important goal of active protection is to prevent valuable technology from falling into the wrong hands, the response may be a destructive action that can cause enough damage so as to render the technology valueless to the unauthorized investigator.

SUMMARY

The present invention provides systems and methods for protecting electronic and other sensitive devices in the event of security breaches such as physical intrusion or access, tampering, and attempts at reverse engineering. More particularly, the present invention provides security systems and methods that can utilize an active security measure that can identify a security breach and respond with a protective action. Protective actions may include erasure or randomizing of data or software, activation of an alarm or signal (such as at a remote location), or destruction of any portion of a protected device or circuit and/or the like.

In accordance with one aspect of the present invention, a thin-film security layer is integrated with an electronic device so that a security breach such as unauthorized access, tampering, analysis, or the like of such electronic device causes an identifiable change in one or more characteristics, such as an electrical or optical characteristic, of the thin-film security layer. The change in the electrical characteristic(s) can directly or indirectly trigger a desired follow up security action in response to unauthorized access, tampering, or analysis of the protected electronic device. For instance, the change in characteristic(s) can be used to initiate a security activity such as triggering an alarm or other notice of intrusion, causing a data or software protection activity, or causing a self-destruct activity as described in greater detail below.

In some embodiments of the present invention, such as those in which the thin-film layer incorporates piezoelectric material, the thin-film layer is self-powered and can directly output an electrical signal to initiate a security response. In other embodiments of the present invention, the change in characteristic(s) indirectly triggers a security response in that the change in characteristic(s) is measured or sensed by, for example, a monitoring device, circuit, or system and a security response is initiated if the measurement indicates a security breach or issue.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
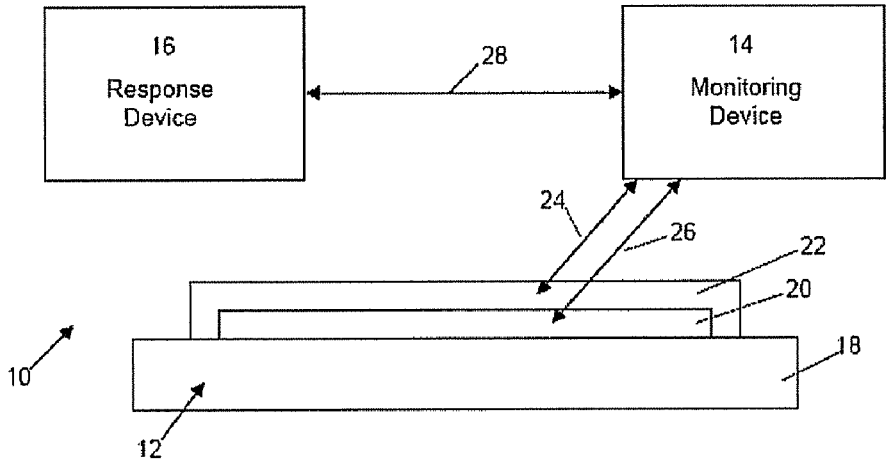
FIG. 1 is a schematic view of an exemplary electronic system in accordance with the present invention comprising an electronic device, a monitoring device, and a response device and showing in particular a thin-film security layer integrated with electronic circuitry of the electronic device.

Electronic system 10, as schematically shown in FIG. 1, illustrates an exemplary implementation of security techniques in accordance with the present invention. Electronic system 10, preferably includes electronic device 12, monitoring device 14, and response device 16, which may be distinct from electronic device 12 as shown or can be integrated with electronic device 12 as noted below. As illustrated, electronic device 12 preferably includes substrate 18, electronic circuitry 20, and thin-film security layer 22 integrated with electronic circuitry 20 in accordance with the present invention and as described in more detail below. Additional security features such as protective overcoats and the like may also be used as described below with respect to the exemplary electronic device shown in FIG. 2.

Electronic system 10 also preferably comprises signal-based communication link 24 between thin-film layer 22 and monitoring device 14, signal-based communication link 26 between electronic circuitry 20 and monitoring device 14, and signal-based communication link 28 between monitoring device 14 and response device 16. Such signal-based communication may comprise wired or wireless communication.

Generally, system 10 is designed so that a security breach such as unauthorized access, tampering, or analysis of electronic device 12 causes an identifiable change in one or more characteristic(s), such as an electrical or optical characteristic, of thin-film layer 22. In accordance with the present invention, a change in a characteristic(s) of thin-film layer 22 can be provided to or sensed by monitoring device 14 via communication link 24, in response to unauthorized access, tampering, or analysis of electronic device 12. Such a change in thin-film layer 22 can be used to initiate one or more desired security activity(ies). For example, monitoring device 14 can activate response device 16 which can cause one or more security activities such as triggering an alarm, sending a signal to a remote monitoring system, causing a data protection activity, or causing a self-destruct activity as described in greater detail below.

Thin-film layer 22 preferably comprises one or more electrically or optically responsive materials wherein one or more characteristic(s) of the material are altered by physical, chemical, optical, or temperature stresses. Examples of such characteristic(s) include capacitance, resistance, inductance, and voltage that can be used to indicate a breach in security. A triggering event such as physical attack (indicated by pressure, abrasion, stress, strain, for example), thermal attack (heating or chilling), chemical attack, optical exposure and the like causes a change in such characteristic(s), which can be identified and used to initiate a protective or security action (s).

A wide variety of materials can be used singly or in combination in order form thin-film security layers of the present invention, such as thin-film layer 22. Such materials may be polymeric or otherwise organic, inorganic, metals, metal alloys, intermetallic compositions, semiconductor materials, combinations of these and the like. One or more piezoelectric materials are preferred. When a piezoelectric material is mechanically strained or otherwise altered, such as by applying force or pressure, a signal in the form of a measurable voltage is produced. Advantageously, such voltage can be used by monitoring device 14, or any other device or circuit, to identify tampering or an attempt at physically accessing electronic circuitry 20. As an additional advantage, the piezoelectric properties are self-powered in the sense that piezoelectric material does not require a separate power source to provide a response to a security breach. Because one need not rely on a separate power source, such as a battery or access to a power grid, to maintain functionality, the security function is not vulnerable to the separate power source being compromised by tampering, wear and tear, too limited shelf life, or the like. Thus, the ability of a piezoelectric material to be self-powered leads to a very long shelf life and enhanced reliability for the security function.

One class of preferred materials having piezoelectric properties includes, for instance, barium titanate, barium strontium titanate, combinations of these, or the like. Also, polymers having piezoelectric properties can be used. Examples of piezoelectric polymers include, for example, polyvinylidene fluoride (PVDF), combinations of these, and the like. Materials that have tunable characteristics may also be used. A tunable characteristic of a material relates to the ability of a material to receive a signal at a specific frequency. When a thin-film of such a material is damaged or disturbed, by physical or chemical attack, for example, the material will receive a signal at a different frequency. A receiver or transmitter in communication with a thin-film security coating of a tunable material can identify the change in frequency and trigger a security activity. Another type of materials that can be used are those that are optically responsive, such as lithium niobate and similar materials. Such optically sensitive materials can be used together with an optical transceiver or the like in accordance with the present invention to sense a change in a characteristic(s) of such materials. In any event, any material that can provide an identifiable change in a characteristic or property in response to a security breach without unduly interfering with the functionality or operation of the electronic device 12 can be used.

As illustrated, only a single thin-film security layer 22 is shown. However, plural layers of the same or different electrically or optically responsive material(s) may be used. Such layers can be layered on top of one another in an overlapping or stacked manner as a multilayer structure (of different material compositions, for example) or can be spaced from each other at various predetermined locations. Plural layers of the same or different materials can be used to provide a protective function at various predetermined locations without the need to cover the entire electronic device with the material(s). This can be used to provide redundancy or to provide specific protection at particular locations. Plural layers can also be used to sense or indicate a particular type of security breach. In this way, broader protection can be provided. For example, one layer could comprise a material with piezoelectric properties that can be used to identify a mechanical condition such as pressure caused by touching or contacting some portion of the electronic device 12. Such a layer can be strategically positioned to sense or indicate touching of a contact pad, lid, or other sensitive portion of the electronic device 12. Another distinct layer could comprise a material that can indicate mechanical or chemical attack by a change in resistance or the like and can be used together with any number of other layers. Another distinct layer could be used to sense a change in an optical characteristic such as exposure to light or a change from a light to dark condition or vice versa Thin-film layer 22, as illustrated, substantially covers electronic circuitry 20. Many alternative configurations are within the scope of the present invention. For example, thin-film layer 22 can cover, coat, or be positioned over, within, or below any portion of electronic device 12. Thin-film layer 22 can be designed to provide blanket coverage or may be selectively patterned in any desired way to form pads, stripes, grids, and the like. Moreover, thin-film layer 22 can be in direct contact with or spaced from electronic device 12, as part of a multilayer structure, for example. Thin-film layer 22 can also be integrated with electronic device 12 wherein thin-film layer 22 is provided under some portion of electronic device 12. For example, any portion of the electronic circuitry 20 can be formed on top of thin-film layer 22. In any event, thin-film layer 22 is designed to be integrated, incorporated, or otherwise provided with respect to electronic circuitry 20 so that a security breach (physical, mechanical, chemical attack or access) causes an identifiable change in an electrical or optical characteristic(s) of thin-film layer 22 as noted above.

The thickness of thin-film layer 22 can vary over a wide range. However, if layer 22 is too thick, then more material would be used to make the layer than is required for the desired functionality. Additionally, the sensitivity of the layer to triggering events would be reduced in that a thicker layer may tend to be more resistant to stresses otherwise induced by triggering events. Thicker layers are also more readily observed upon reverse engineering, making it easier for an unauthorized person to discern the presence of the security feature. Yet, the layer should not be too thin in that it could be more susceptible to damage by ordinary events not associated with unauthorized access. The desired thickness may also be selected based on factors such as material composition, deposition technique, and the like.

For example, a thin-film layer having a thickness in the range of from about 10 Angstroms to about 50 microns would be suitable in many embodiments. More preferably, a thin-film layer having a thickness in the range of from about 0.1 microns to about 25 microns is preferred. Such thicknesses are advantageous where low electrical resistance is desired for thin-film layer 22 because of design or power limitations for electronic circuitry 20, for example. Moreover, such layer thicknesses are preferred as the resultant thin-film layers are generally sensitive to tampering but not too fragile. The presence of the resultant layers also is more difficult to discern as a security device, thus making the security aspects more difficult to circumvent. The thickness of thin-film layer 22 is preferably uniform but may vary based on factors such as design, the nature of the item(s) on which the layer is formed, the deposition process used, and/or the like.

Thin-film layer 22 can be provided by any thin-film deposition technique. Preferred deposition techniques include chemical vapor deposition and combustion chemical vapor deposition. Chemical vapor deposition is well known in the semiconductor processing arts and an example of a combustion chemical vapor deposition process can be found in U.S. Pat. No. 6,013,318 to Hunt et al., the disclosure of which is incorporated herein by reference for all purposes. Preferably, during deposition of thin-film layer 22 the temperature of electronic device 12 is controlled as needed to avoid or prevent damage to electronic device 12. Other deposition techniques that can be used include laser spallation, chemical vapor deposition, electron-beam physical vapor deposition, laser physical vapor deposition, and laser ablation.

As shown, monitoring device 14 can preferably communicate with electronic circuitry 20 via communication link 26 and can also preferably communicate with thin-film layer 22 via communication link 24. Preferably, monitoring device 14 comprises electronic circuitry that can measure a condition and/or receive a signal from thin-film layer 22. Monitoring device 14 can be integrated with electronic circuitry 20 or provided as a distinct circuit on substrate 18. Monitoring device 14 can also be designed as a remote device or circuit that is separate from electronic device 12.

Response device 16, as illustrated, can preferably communicate with monitoring device 14 via communication link 28. As shown, response device 16 can communicate indirectly with electronic circuitry 20 and thin-film layer 22 through monitoring device 14. However, electronic system 10 can be designed so that response device 16 can communicate directly with electronic circuitry 20 and/or thin-film layer 22 via appropriate communication links. Response device 16 may be integrated with monitoring device 14 and/or electronic circuitry 20 or may be distinct.

In accordance with the present invention, response device 16 is preferably capable of responding to a security breach with a protective or security measure or the like. Preferably, response device 16 is capable of causing data protection activities such as erasing, overwriting, transmitting, or randomizing data and/or software stored in electronic circuitry 20. In this regard, response device 16 may comprise a circuit having an algorithm that can carry out program instructions for accomplishing such data and/or software protection. Response device 16 may comprise a communication device such as a transponder, transmitter, or homing device (such as may communicate with a GPS based system or the like), that can be activated based on a signal or change in condition of thin-film layer 22 indicating a security breach. Such a communication device can be used to activate a remotely located alarm or otherwise initiate a remote protective action. Response device 16 may also comprise a self-destruct device such as a thermal battery or the like. The use of thermal batteries for protecting an electronic device is described in U.S. Provisional Patent Application, "Using Thin Film, Thermal Batteries to Provide Security Protection for Electronic Systems," filed on Dec. 9, 2004, in the name of Kenneth H. Heffner, having Ser. No. 60/634,737, assigned to the assignee of the present invention, and fully incorporated herein for all purposes.

In accordance with the present invention, one or more bonding or buffer layers may be used together with thin-film layer 22. Generally, a bonding layer may be used in order improve or facilitate bonding, adherence, or attachment of thin-film layer 22 with any desired portion of electronic device 30. A buffer layer may be used in order to provide a separation between some portion of electronic device 30 and thin-film layer 22. For example, an electrically insulating buffer layer may be used to separate an electrically conducting thin-film security layer from an underlying device structure.

Figure 2:
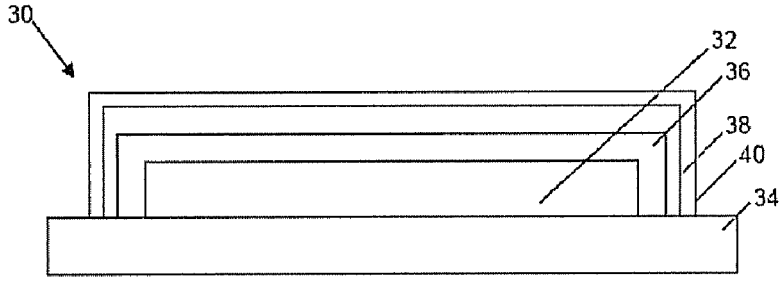
FIG. 2 is a schematic view of another electronic device comprising a buffer layer, a thin-film security layer, and a tamper resistant coating in accordance with the present invention.

A representative use of a buffer layer is illustrated in FIG. 2, where another exemplary electronic device 30 in accordance with the present invention is shown. Electronic device 30 can be used as the electronic device 12 in electronic system 10 shown in FIG. 1 and as described above. Electronic device 30 preferably comprises electronic circuitry 32 provided on substrate 34. As shown, buffer layer 34 is provided on electronic circuitry 32 and thin-film security layer 36 is provided on buffer layer 34. Thin-film layer 36 is preferably designed in accordance with thin-film layer 22 described above with respect to the electronic device shown in FIG. 1. Buffer layer 34 may comprise any known or future developed material that can help or enable integration of thin-film layer 36 with electronic device 30 in accordance with the present invention. Buffer layer 34 can be designed to help control or manage bonding of similar or dissimilar materials, thermal expansion mismatch, and the like, for example.

As illustrated, electronic device 30 may also include protective overcoat 40 that further enhances security. Overcoat 40 can be designed so that it can provide active or passive protection. As examples of passive protection, overcoat 40 may be formed of a material that masks the presence of any of electronic circuitry 32 and thin-film layer 38 incorporating materials or structure that confound or otherwise interfere with attempts to visually, radiographically, sonically, or otherwise investigate the overcoated structures. As an example of an active protection, overcoat 40 may include material that is benign in a neutral pH environment, but that becomes extremely corrosive or caustic in the event that the overcoat integrity is interrogated with corrosive or caustic agents. The resultant reactivity can be used to trigger security operations in accordance with the present invention. Examples of such security measures are further described in U.S. Pat. Nos. 6,319,740; 6,287985; and 6,013,318.

Figure 3:
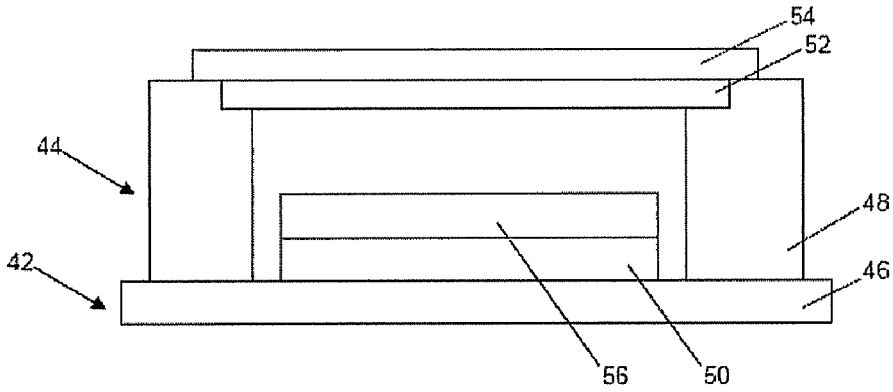
FIG. 3 is a schematic view of another electronic device comprising electronic circuitry within a package comprising a body and a lid and a thin-film security layer providing a security function with respect to the lid in accordance with the present invention.

Another exemplary electronic device 42 that can be used in the electronic system 10 is illustrated in FIG. 3. Electronic device 42 shows an exemplary manner in which plural thin-film security layers can be incorporated with an electronic device or circuit in accordance with the present invention in different strategic placements. As illustrated, electronic device 42 comprises packaged device 44 on substrate 46. Packaged device 44 comprises body 48 having electronic circuitry 50 enclosed therein and lid 52, as shown. Thin-film security layer 54 is provided on lid 52 as illustrated and may be designed as described above. In this way, thin-film layer 54 can be used to signal a breach or attempt to breach lid 52 in order to access electronic circuitry 50. Optionally, as illustrated, thin-film layer 56 may be integrated with electronic circuitry 50 thus providing an additional security feature.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

What is claimed is:

1. A secure electronic system comprising an electronic device, the electronic device comprising electronic circuitry and a thin-film security layer integrated with at least a portion of the electronic circuitry so that physical access of said portion of the electronic circuitry causes an identifiable change in a characteristic of the thin-film security layer, wherein the thin-film security layer comprises a material with an optically responsive characteristic and wherein physical access of said portion of the electronic circuitry causes a change in an optical property of the material with an optically responsive characteristic.

2. The system of claim 1, wherein the thin-film security layer covers at least a portion of said portion of the electronic circuitry.

3. The system of claim 1, wherein said physical access includes at least one of mechanical, chemical, and optical access.

4. The system of claim 1, further comprising a signal-based communication link between the electronic circuitry and the thin-film security layer.

5. The system of claim 1, wherein the electronic circuitry comprises a response device that can be activated in response to the identifiable change in a characteristic of the thin-film security layer.

6. The system of claim 5, wherein the response device comprises at least one of a thermal battery and a communication device.

7. A method of securing an electronic device against unauthorized access, the method comprising the steps of: providing an electronic device having electronic circuitry; and integrating a thin-film security layer with at least a portion of the electronic circuitry in a manner effective to generate an identifiable change in a characteristic of the thin-film security layer in response to an event indicative of unauthorized access to said portion of the electronic circuitry, wherein the thin-film security layer comprises a material with an optically responsive characteristic and wherein the identifiable change in a characteristic of the thin-film security layer is a change in an optical property the material with an optically responsive characteristic.

8. The method of claim 7, wherein the step of integrating a thin-film security layer with at least a portion of the electronic circuitry comprises coating said portion of the electronic circuitry with the thin-film layer by a deposition process.

9. The method of claim 8, wherein the deposition process comprises one of chemical vapor deposition and combustion chemical vapor deposition.

10. The method of claim 8, wherein the deposition process comprises a vacuum deposition process.

11. The method of claim 8, further comprising controlling the temperature of said portion of the electronic circuitry during the deposition process.

12. The method of claim 8, further comprising coating said portion of the electronic circuitry with at least one of a buffer layer and a bonding layer before coating said portion of the electronic circuitry with the thin-film layer.

13. A method of securing an electronic device against unauthorized access, the method comprising the steps of: providing an electronic device having electronic circuitry and a thin-film security layer integrated with at least a portion of the electronic circuitry; causing an identifiable change in a characteristic of the thin-film security layer in response to unauthorized access to said portion of the electronic circuitry; and initiating a security action in response to the identifiable change in a characteristic of the thin-film security layer, wherein the thin-film security layer comprises a material with an optically responsive characteristic and wherein the identifiable change in a characteristic of the thin-film security layer is a change in an optical property of the material with an optically responsive characteristic.

14. The method of claim 13, wherein the step of initiating a security action comprises establishing communication with a monitoring device.

15. The method of claim 13, wherein the step of initiating a security action comprises at least one of erasing and randomizing said portion of the electronic circuitry.

16. The method of claim 13, wherein the step of initiating a security action comprises activating a response device.

17. The method of claim 16, wherein the response device comprises at least one of a thermal battery and a transponder.

* * * * *